United States Patent [19]

Yoneda et al.

[11] 4,285,318

[45] Aug. 25, 1981

[54] EXHAUST GAS RECIRCULATION SYSTEM HAVING FLOW CONTROL VALVE COMBINED WITH SUPERSONIC NOZZLE

[75] Inventors: Kenji Yoneda, Yokohama; Tadahiro Yamamoto, Yokosuka; Kunihiko Sugihara, Yokohama, all of Japan

[73] Assignee: Nissan Motor Company, Ltd., Japan

[21] Appl. No.: 601,053

[22] Filed: Aug. 1, 1975

[30] Foreign Application Priority Data

Aug. 5, 1974 [JP] Japan ..... 49-90051

[51] Int. Cl.[3] ..... F02M 25/06

[52] U.S. Cl. ..... 123/568

[58] Field of Search ..... 123/119 A, 119 EE, 568; 137/242

[56] References Cited

U.S. PATENT DOCUMENTS

| | | | |
|---|---|---|---|
| 1,086,637 | 2/1914 | Beach | 137/242 |
| 1,314,559 | 2/1919 | Wilson | 137/242 |
| 2,570,629 | 10/1951 | Anxionnaz et al. | 60/35.5 |
| 3,641,989 | 2/1972 | Hill | 123/119 A |
| 3,730,160 | 5/1973 | Hughes | 123/119 A |
| 3,834,364 | 9/1974 | Bartholomew | 123/119 A |
| 3,868,936 | 3/1975 | Rivere | 123/119 EE |
| 3,970,061 | 7/1976 | Caldwell | 123/119 A |
| 3,981,283 | 9/1976 | Kaufman | 123/119 A |

FOREIGN PATENT DOCUMENTS

| | | | |
|---|---|---|---|
| 675565 | 12/1963 | Canada | 137/242 |

*Primary Examiner*—Wendell E. Burns

*Attorney, Agent, or Firm*—Robert E. Burns; Emmanuel J. Lobato; Bruce L. Adams

[57] ABSTRACT

A channel for recirculating a portion of an engine exhaust gas to the induction passage has an intermediately arranged converging-diverging supersonic nozzle with a valve member arranged in the nozzle to vary the cross-sectional area of the channel at the throat, so that the mass flow rate of the recirculated exhaust gas depends solely on the cross-sectional area so far as the gas velocity at the throat is sonic.

8 Claims, 8 Drawing Figures

EXHAUST GAS RECIRCULATION SYSTEM HAVING FLOW CONTROL VALVE COMBINED WITH SUPERSONIC NOZZLE

BACKGROUND OF THE INVENTION

This invention relates generally to an exhaust gas recirculation system in an internal combustion engine, and more particularly to a control valve for controlling the mass flow rate of the recirculated exhaust gas in such a system.

Many of the current internal combustion engines, particularly those which are installed on automobiles, are equipped with a system for recirculating a portion of exhaust gas from the exhaust system to the intake system of the engine for the purpose of reducing the concentrations of oxides of nitrogen in the exhaust gas. It is a usual practice to control the amount of the recirculated exhaust gas in such a system by means of a flow control valve the opening of which varies and determines a minimum cross sectional area of an exhaust gas recirculation passageway or channel in response to a signal representing the mass flow rate of air taken into the engine. This manner of control involves a problem in that the mass flow rate of the recirculated exhaust gas does vary even when the valve opening is kept constant because the velocity of the gas flow varies with variations in the pressure difference between the upstream and downstream sections of the control valve. In other words, the magnitudes of both the exhaust gas pressure and intake vacuum are important parameters in addition to the degree of the control valve opening in controlling the amount or volume of recirculated exhaust gas.

In practical applications, however, it is quite difficult to control the recirculation of exhaust gas in correlation to both the magnitude of the intake vacuum and the aforementioned pressure difference. Especially when such a complicated manner of control is intended at relatively low engine speeds, it has been almost impossible to accomplish the intended control without impairing operational characteristics of the engine.

SUMMARY OF THE INVENTION

It is an object of the present invention to provide an exhaust gas recirculation system in which the amount or volume of the recirculated exhaust gas can be controlled under substantially no influence of variations in the magnitude of pressure difference between vacuum developed in the intake system of the engine and the exhaust gas pressure.

It is another object of the invention to provide an exhaust gas recirculation system in which the influence of the described pressure difference on the amount of the recirculated exhaust gas is excluded when the pressure difference is greater than a predetermined magnitude.

According to the present invention, there is provided an exhaust gas recirculation system in an internal combustion engine, which system comprises: a fluid flow channel connecting an exhaust passage of the engine to an induction passage of the engine for recirculating a portion of the exhaust gas therethrough; a converging-diverging nozzle formed at an intermediate section of the recirculation channel, which nozzle is shaped such that the velocity of the recirculated exhaust gas is sonic at the throat of the nozzle when the pressure difference between the entrance and exit pressures of the nozzle exceeds a predetermined magnitude; a valve member arranged in association with the nozzle to pass through the throat; and a mechanism for supporting and moving the valve member thereby to vary the cross-sectional area of the recirculation channel at the throat of the nozzle.

The valve member is preferably a tapered member which is arranged to move in the axial directions of the nozzle.

BRIEF DESCRIPTION OF THE DRAWINGS

Other features and advantages of the invention will become apparent from the following detailed description of preferred embodiments thereof with reference to the accompanying drawings, in which.

DESCRIPTION OF THE PREFERRED EMBODMENTS

Figure 1:
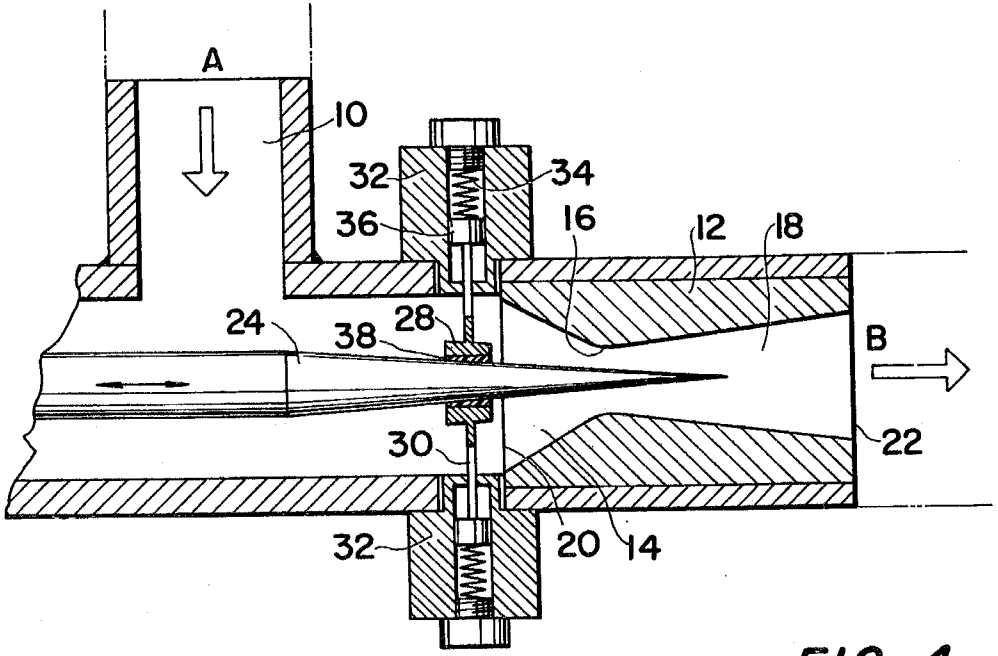
FIG. 1 is a fragmentary and sectional side elevation view of a recirculation channel in a system according to the invention showing a supersonic nozzle and a valve member.

Referring to FIG. 1, a recirculation conduit or channel 10 which branches away from an exhaust pipe (not shown) of an internal combustion engine and terminates at a section of the induction passage of the engine such as an intake manifold (not shown) has a converging-diverging nozzle 12 in its intermediate section as an essential feature of the invention.

In general the velocity of a fluid flow through a stream tube increases as the cross-sectional area of the tube decreases in accordance with the equation of continuity when the fluid velocity is subsonic. If the fluid velocity is supersonic, on the other hand, there occurs a decrease in the fluid velocity as the cross-sectional area of the tube decreases until the velocity becomes sonic at a certain section. In the latter case the mass rate of the fluid flow is determined solely by the cross-sectional area of the section at which the velocity is sonic.

The nozzle 12 is shaped in a well known fashion so that the velocity of the flow of the recirculated exhaust gas (represented by the arrow A) may be increased in the converging section 14 of the nozzle 12 until it equals the velocity of sound at a narrowest section, i.e., throat 16. The subsequent section 18 of this nozzle 12 is diverging so that the velocity of the exhaust gas flow is supersonic in this section 18 and takes a maximum value usually before the flow arrives at the exit 22 of the nozzle 12. The exhaust gas is then drawn into the intake manifold through the remaining section of the channel 10 downstream of the nozzle 12 as represented by the arrow B. This nozzle 12 has a circular cross section, and the entrance 20, throat 16 and exit 22 have appropriately determined areas, respectively, based on the expected entrance and exit pressures in order to realize the sonic flow at the throat 16.

An elongated conical valve member 24 extends in the channel 10. The thinner portion of the valve member 24 enters the nozzle 12 at the entrance 20 to the converging section 14 and extends into the diverging section 18 passing through the throat 16 with radial tolerance. The conical valve member 24 may alternatively be tapered reversely to the illustration in FIG. 1. The valve member 24 is arranged coaxially to the nozzle 12 and is axially movable in opposite directions. Thus an effective throat area of the nozzle 12 or a minimum cross-sectional area of the channel 10 can be varied by selectively moving the valve member 24 axially.

When the exhaust gas flow is supersonic in the diverging section 18 of the nozzle 12, the flow is sonic at the throat 16 even if the effective throat area is varied by the movement of the valve member 24. Accordingly the mass flow rate of the exhaust gas through the nozzle 12 is solely a linear function of the effective throat area and does not depend on the pressure difference between the entrance and exit pressures. Consequently the amount or volume of the recirculated exhaust gas can be controlled precisely in correlation to the position of the valve member 24 or the distance through which the valve member 24 is moved.

The surface of the valve member 24 may suffer from deposition of carbonaceous particles contained in the exhaust gas when the valve member 24 is subjected to a prolonged use. Such deposition means unfavorably increase in the effective cross-sectional area at any section of the valve member 24 and may cause an actual value of the effective throat area to deviate from the intended value. The valve member 24 is preferably provided with a preventive measure against accumulation of carbonaceous deposits thereon. In the embodiment of FIG. 1, a plurality of wipers 28, which are arc-shaped in cross section and cone-frustum in side elevation, are placed on the surface of the valve member 24 at a section close to the entrance 20 to the nozzle 12. Each wiper 28 has a stem 30 which extends normal to the longitudinal axis of the valve member 24 and outwardly of the channel 10 and is received in a housing 32 mounted on the wall of the channel 10. The housing 32 has therein a compression spring 34 and a piston 36 in such an arrangement that the spring force is exerted on the stem 30 in the axial direction through the piston 36. The wiper 28 is curved in cross-section with a radius of curvature corresponding to a medium radius of the valve member 24 in an intermediate portion coming into contact with the wipers 28 as the valve member 24 is moved. The inner surface of each wiper 28 is covered with a layer 38 of a resilient and lubricating material such as a polytetrafluoroethylene resin to prevent friction wear of the valve member 24. The force of the spring 34 is adjusted such that an axial movement of the valve member 24 causes each wiper 28 to move radially of the valve member keeping contact with the valve member 24, so that most of the solid particles deposited on the surface of the valve member 24 can be wiped away. It is possible to clean the valve member 24 around its entire periphery by turning the valve member 24 on its axis when it moves axially.

Figure 2:
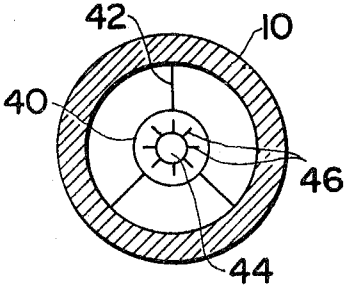
FIG. 2 is a cross-sectional view of a similar channel showing a device disposed therein for preventing accumulation of carbonaceous deposits on the surface of the valve member.

FIG. 2 shows another example of cleaning measures for the valve member 24. In this case an annular member 40 of a lubricating and flexible material as typified by a polytetrafluoroethylene resin serves as a wiper element. The member 40 is held in position at the same location as the wipers 28 in the case of FIG. 1 by a plurality of wires 42 fixed to the wall of the channel 10. The central hole 44 of the member 40 has a diameter appropriate for allowing the valve member 24 to pass tightly therethrough, and a plurality of radial slits 46 are formed through a certain distance from the periphery of the hole 44. Thus the hole 44 can be enlarged when the valve member 24 moves axially, and the surface of the valve member 24 is wiped by the member 40.

Figure 3:
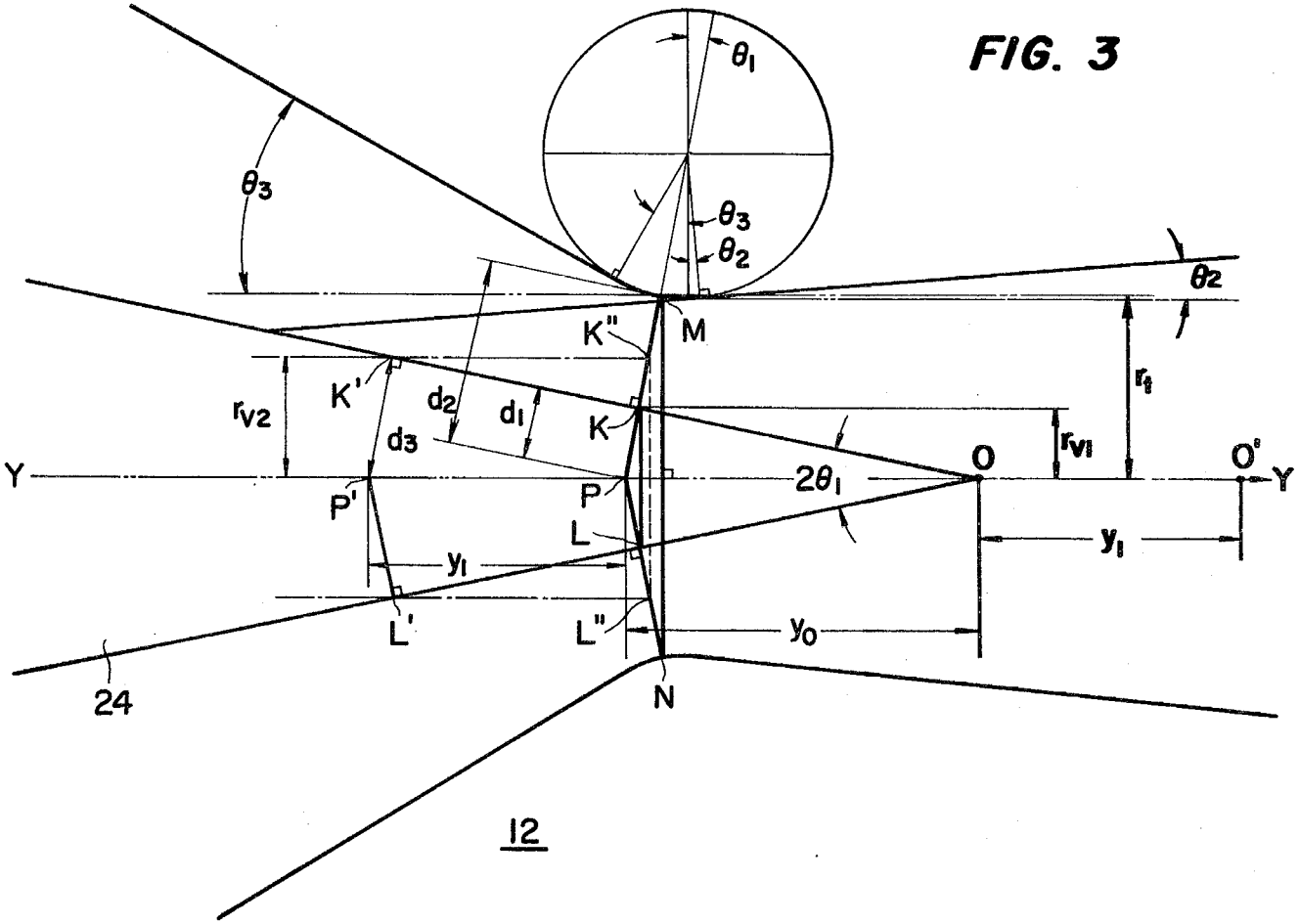
FIG. 3 is an explanatory diagram of the same nozzle and valve embmer of FIG. 1 for the explanation of the relationship between the position of the valve member and a minimum cross-sectional area of the channel at the nozzle throat.

Variations in the amount of the recirculated exhaust gas passing through the nozzle 12 of FIG. 1 with respect to variations in the axial travel of the valve member 24 will be explained hereinafter. FIG. 3 shows an extreme position of the valve member 24 that gives the largest effective throat area, and the Y-axis is taken in the direction of the longitudinal axis of the valve member 24 and hence of the nozzle 12. The amount or mass flow rate of the recirculated exhaust gas is proportional to a minimum sectional area of the channel 10 defined by the throat 16 of the nozzle 12 and the valve member 24. The minimum sectional area S with the valve member 24 at any position is defined and determined as follows. The throat 16 is represented in FIG. 3 by the diameter M-N, and perpendiculars are dropped from the points M and N to the surface of the valve member 24, which perpendiculars intersect the surface at points K and L, respectively, and meet at a point P on the Y-axis. Then the narrowest section of the channel 10 is given by the lateral surface of the cone frustum KLMN. The narrowest section is given always in the plane of the lateral surface of this cone frustum althrough the area S of this section decreases as the valve member 24 moves to the right in FIG. 3. The point P is at a distance $y_o$ from the top end of the valve member 24, which is indicated at O as the origin of the co-ordinate.

Another point P' is placed on the Y-axis at a distance $y_1$ to the left from the point P, and perpendiculars dropped from this point P' to the surface of the valve member 24 give two points K' and L' as their feet.

Assume that the valve member 24 is moved to the right through the distance $y_1$, then the top end moves from the origin O to a point O' on the Y-axis, and the point P' reaches the point P. Also the points K' and L' move in the parallel direction to the Y-axis and fall on the lines MK and NL at K'' and L'', respecitvely. In this state, the narrowest section of the channel 10 is given by the side surface of a shortened cone frustum K''L''NM. Let the radius of the throat 16 be $r_t$, the radii of the valve member 24 at KL and K'L' be $r_{v1}$ and $r_{v2}$, respectively, length PK be $d_1$, length PM be $d_2$ and length P'K' be $d_3$. Then the minimum sectional area $S_o$ of the channel 10 when the valve member is positioned to give a maximum mass flow rate of the recirculated exhaust gas (when the top end remains at 0) is given by $$S_o+\pi(r_t\cdot d_2-r_{v1}\cdot d_1) \quad (1)$$

When the valve member travels to the right through the distance $y_1$, the minimum sectional area of the channel becomes $$S=\pi(r_r d_2 - r_{v2} \cdot d_3) \quad (2)$$

Since the two triangles OPK and OP'K' are symmetric, there holds $$\frac{y_1 + y_o}{y_o} = \frac{d_3}{d_1} = \frac{r_{v2}}{r_{v1}} \quad (3)$$

Accordingly, $$d_3 = d_1\left(\frac{y_1 + y_o}{y_o}\right) \quad (4)$$

$$r_{v2} = r_{v1}\left(\frac{y_1 + y_o}{y_o}\right) \quad (5)$$

Using Equations (4) and (5), Equation (2) becomes $$S = \pi\left\{ r_t \cdot d_2 - d_1 \cdot r_{v1}\left(\frac{y_1 + y_o}{y_o}\right)^2 \right\} \quad (6)$$

Application of Equation (1) to Equation (6) gives $$S=S_o-\pi \cdot r_{v1} d_1 \cdot y_1/y_o\,(2+y_1/y_o) \quad (7)$$

Let the semivertical angle of the conical valve member 24 be $\theta_1$, then $$d_1=y_o \sin\theta_1 \quad (8)$$

$$r_{v1}=d_1 \cos\theta_1=y_o \sin\theta_1 \cos\theta_1=y_o/2(\sin 2\theta_1) \quad (9)$$

Using Equations (8) and (9), Equation (7) becomes $$S=S_o-(\pi/2)y_1 \cdot y_o \sin 2\theta_1 \sin\theta_1\,(2+y_1/y_o) \quad (10)$$

The mass flow rate of the recirculated exhaust gas G is proportional to the sectional area S and takes a maximum value $G_{max}$ when the sectional area is $S_o$. Accordingly, the mass flow rate G at any position of the valve member 24 is expressed by $$G=G_{max}(S/S_o) \quad (11)$$

Consequently, G is correlated to the travel or lift y of the valve member as $$G=G_{max}/S_o\{S_o-(\pi/2)y \cdot y_o \sin 2\theta_1 \sin\theta_1(2+y/y_o)\} \quad (12)$$

Equation (12) verifies that the mass flow rate of the exhaust gas through the nozzle 12 can be regulated to any value less than a maximum value by axially moving the valve member 24.

Figure 4:
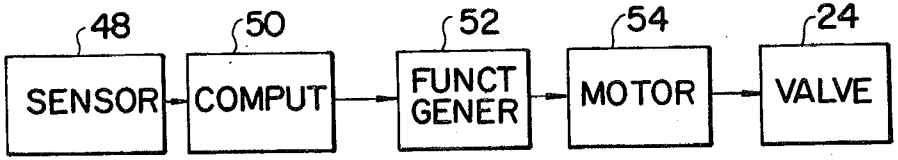
FIG. 4 is a block diagram of a subsystem for moving the valve member of FIG. 1.

The valve member 24 can be operated by any conventional valve-actuating device such as, e.g., a linear motor or a vacuum motor. The actuating device is governed by a control apparatus the output of which varies with variations in one or more variables correlated to the operation modes of the engine. Examples of such variables are the quantity of air taken into the engine, vacuum at the venturi of a carburetor, engine temperature and acceleration or deceleration of the vehicle. FIG. 4 shows a block diagram of a control system for regulating the axial position of the valve member 24 by way of example. In this system, a computer 50 provides a control signal based on a data signal from a sensor 48 detecting one or more of the above described variables to a function generator 52. The function generator 52 gives a fluctuating output to control the operation of a linear motor 54 which advances and retracts the valve member 24.

A sonic flow of the recirculated exhaust gas can be attained with the combination of the nozzle 12 and the valve member 24 of FIG. 3 over practically an almost entire ranges of engine speed and load when the nozzle 12 and the valve member 24 are shaped and correlated to each other appropriately. More particularly, the sonic flow can be realized when the magnitude of the intake manifold vacuum is at least about −110 mmHg by determining the semivertical angle $\theta_1$ of the valve member 24, the divergent angle $\theta_2$ and convergent angle $\theta_3$ of the nozzle 12 within the following ranges, respectively: $\theta_1 \leqq 30°$, $\theta_2 \leqq 10°$ and $\theta_3 \leqq 90°$. When the conical valve member 24 is arranged as in FIG. 3, a diverging section can be formed even if the angle $\theta_2$ is zero or below. In such a case the angle $\theta_2$ must be in the range between 0° and −10°. When the valve member 24 is arranged in the reverse direction, a converging section can be formed even if the angle $\theta_3$ is zero or below, but the angle $\theta_3$ should be in the range between 0° and 90° even in such a case.

As will have been understood from the foregoing description, it is possible to control the amount of the recirculated exhaust gas to an optimum value over almost a whole range of the engine operation under no influence of the pressure difference between the intake vacuum and the exhaust gas pressure.

In practical applications, the valve member 24 of FIG. 1 is preferably combined with a conventional valve actuator which is responsive to changes in the magnitude of vacuum in the venturi section of a carburetor for the engine because of an experimentally confirmed fact that regulation of the amount of the recirculated exhaust gas by means of such an actuator gives a good result when the pressure difference between the entrance and exit pressures of the nozzle 12 is not great enough to cause a supersonic flow in the divergent section 18. In this case, the control valve of FIG. 1 is preferably shaped such that the supersonic flow is realized when the pressure difference between the entrance and exit pressures reaches a magnitude of about 110 to 120 mmHg.

Figure 5:
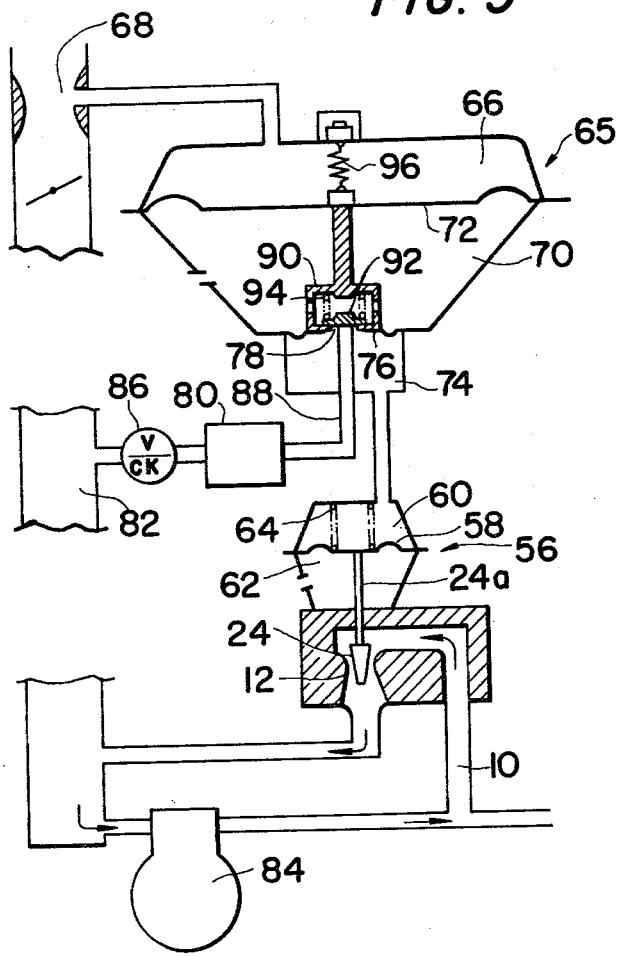
FIG. 5 is a schematic diagram of an exhaust gas recirculation system according to the invention.

FIG. 5 shows a general arrangement of an exhaust gas recirculation system having a valve actuator 56 for moving the valve member 24 to vary the throat area of the nozzle 12. The actuator 56 has a flexible diaphragm 58 which divides the interior of the actuator 56 into two chambers: an upper vacuum chamber 60 and a lower chamber 62 communicating with the atmosphere. The stem **24*a* of the valve member 24 extends upwards through the lower chamber 62 and is fixed to the diaphragm 58. A compression spring 64 is installed in the vacuum chamber 60 to offer an appropriate magnitude of resistance against an upward movement of the diaphragm 58, and the vacuum chamber 60 communicates with a vacuum control device 65. The control device 65 has an uppermost vacuum chamber 66 which communicates with the venturi section 68 of a carburetor, a central chamber 70 which is partitioned from the vacuum chamber 66 by a flexible diaphragm 72 and communicates with the atmosphere and a lowermost vacuum chamber 74 communicating with the vacuum chamber 60 of the actuator 56. Another flexible diaphragm 76 partitions the vacuum chamber 74 from the central chamber 70, but has an opening 78 in its central region. A vacuum reservoir 80 is connected to the intake manifold 82 of the engine 84 via a check valve 86 and is communicable with the vacuum chamber 74 through a pipe 88 which opens at the opening 78 of the diaphragm 76. In the central chamber 70, a valve housing or cage 90 is fixedly placed on the diaphragm 78 and fixed to the upper diaphragm 72 at its upper end. The interior of this cage 90 communicates with the atmosphere. A valve member 92 is disposed in this cage 90 and urged by a compression spring 94 to close both the opening 78 and the open end of the pipe 88. The upper diaphragm 72 has a considerably larger effective area compared with that of the diaphragm 76 and is always exerted with an upwardly pulling force of a tension spring 96**.

When the diaphragm 76 is pulled up together with the cage 90, the vacuum chamber 74 communicates with the vacuum reservoir 80. When the diaphragm 76 is pulled down by the enhanced vacuum in the chamber 74, the open end of the pipe 88 is closed by the valve member 92 and the chamber 74 communicates with the atmosphere. Accordingly, an equilibrium is established in correlation to the magnitude of vacuum in the venturi 68. Thus, the control device 65 amplifies the vacuum in the venturi 68 and gives a vacuum output for operating the actuator 56. The valve member 24 can be moved minutely as the diaphragm 58 of the actuator 56 is deflected.

As explained hereinbefore, the mass flow rate of the recirculated exhaust gas through the nozzle 12 is not proportional to the effective throat area when the exhaust gas flow in the diverging section 18 is subsonic. In this state, the mass flow rate increases even at a constant effective throat area with increase in the pressure difference between the entrance and exit pressures of the nozzle 12. Such a tendency is unfavorable particularly when there is present a comparatively large magnitude of pressure difference. Various experiments have revealed that a critical value of the pressure difference is about 120 mmHg. Accordingly, the nozzle 12 and the valve member 24 are preferably shaped such that the velocity of the recirculated exhaust gas becomes supersonic in the diverging section 18 (hence sonic at the throat 16) when the pressure difference between the entrance and exit pressures of the nozzle 12 reaches 120 mmHg.

Figure 6:
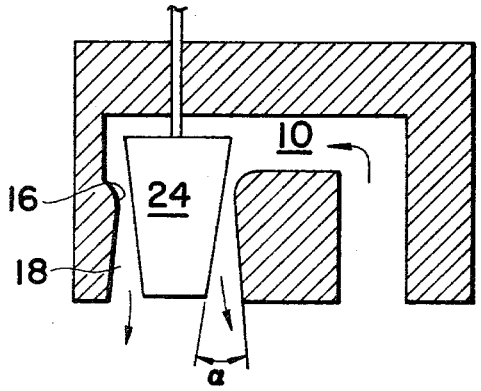
FIG. 6 is an enlarged fragmentary view of the same system for the explanation of an angular relationship between the diverging section of the nozzle and the valve member.
Figure 7:
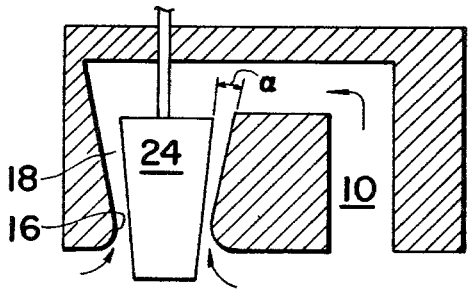
FIG. 7 is fundamentally a similar view to FIG. 6 but shows a reversed arrangement.

It has been confirmed that best results can be obtained when the side face of the valve member 24 and the wall of the diverging section 18 of the nozzle 12 form an angle ranging from 7° to 10° in longitudinal section as shown in FIG. 6. This angle $\alpha$ is the sum of the semivertical angle $\theta_1$ and diverging angle $\theta_2$ in FIG. 3. When the valve member 24 is arranged in the reverse direction (thicker in the diverging section 18 than in the converging section 14) as shown in FIG. 7, this angle $\alpha$ is the sum of $\theta_1$ and $-\theta_2$.

Figure 8:
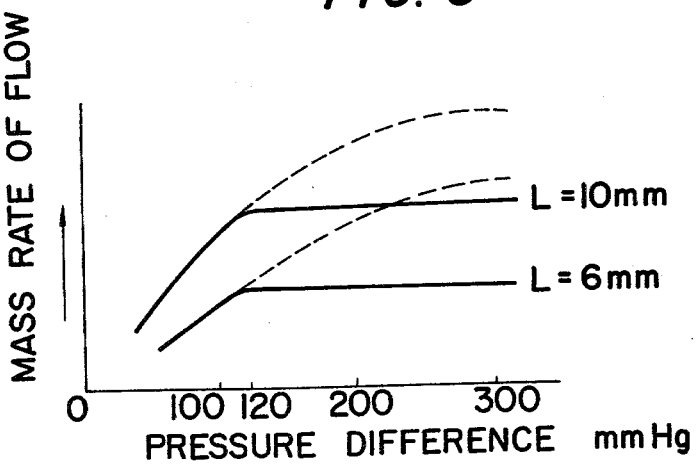
FIG. 8 is an explanatory graph showing the influence of the pressure difference between the entrance and exit pressures of the nozzle of FIG. 6 on the amount of the recirculated exhaust gas in the system of FIG. 5.

The graph of FIG. 8 shows variations in the amount of the recirculated exhaust gas for the system of FIG. 5 when the valve member 24 is kept at fixed positions and the engine speed is gradually increased to increase the pressure difference between the entrance and exit pressures of the nozzle 12. The symbol L represents an upward travel of the valve element 24 from the extreme position where the throat 16 is completely closed. The amount of the recirculated exhaust gas increases, despite the fixed position of the valve member 24 and no increase in the effective throat area, until the pressure difference reaches a magnitude of about 120 mmHg but remains constant thereafter. If the nozzle 12 is not designed so as to attain a supersonic gas flow, the amount of the recirculated exhaust gas continues to increase with increase in the pressure difference as shown by the dotted curves.

The supersonic nozzle 12 and the valve member 24 in the above described embodiments are shaped to have circular cross sections, respectively. The invention, however, is not necessarily limited to such configurations. The same result can be obtained when the converging-diverging nozzle is shaped rectangular in cross section and a wedge-shaped valve member which has a rectangular cross section is arranged to move in the axial directions of the nozzle. As still another modification, the cross-sectionally rectangular supersonic nozzle may be combined with a different type of valve member which has the same shape as the nozzle in longitudinal section and is arranged to slide in the nozzle perpendicularly to the longitudinal section of the nozzle.

What is claimed is:

1. In an internal combustion engine, an exhaust gas recirculation system comprising:

means defining a fluid flow channel connecting an exhaust passage of the engine to an induction passage of the engine to recirculate a portion of the exhaust gas therethrough;

a converging-diverging nozzle circular in cross section disposed at an intermediate section of said channel for flowing recirculated exhaust gas therethrough, said nozzle having a throat and having a converging section and a diverging section shaped such that the velocity of the recirculated exhaust gas is sonic at the throat of said nozzle when a pressure difference between the entrance and exit pressures of said nozzle exceeds a predetermined magnitude;

a conical valve member in said nozzle coaxially therewith to extend through said throat;

the surface of said valve element and inner surfaces of the diverging section defining therebetween an angle from about 7 to 10 degrees in longitudinal section; and means for supporting and moving said valve member axially thereby to vary the cross-sectional area of said channel at said throat.

2. An exhaust gas recirculation system as claimed in claim 1, wherein the semivertical angle of the conical valve member is 30 degrees at the maximum, and the converging section angle and diverging section angle of said nozzle are 90 degrees at the maximum and 10 degrees at the maximum, respectively.

3. An exhaust gas recirculation system as claimed in claim 1, wherein said means for moving said valve element are constituted of: (a) a carburetor associated with the engine; (b) a valve actuator having a flexible diaphragm arranged therein perpendicular to the longitudinal axis of said valve member and forming therein a vacuum chamber, said diaphragm defining a wall of said vacuum chamber; (c) a vacuum control device having a housing forming therein a first chamber communicating with said vacuum chamber, a second chamber communicating with the atmosphere and a third chamber communicating with the venturi section of said carburetor, a first flexible diaphragm having a port and partitioning said first chamber from said second chamber, a second flexible diaphragm partitioning said second chamber from said third chamber and having a larger effective area than said first flexible diaphragm, a rigid member interconnecting said first and second diaphragms, a vacuum reservoir having a pipe extending therefrom to said port, and a valve means for selectively closing and opening said port such that said first chamber communicates with said vacuum reservoir and with said second chamber when said first flexible diaphragm is deflected towards said second chamber and towards said first chamber, respectively.

4. An exhaust gas recirculation system as claimed in claim 1, wherein said valve member is disposed such that said valve member is smaller in diameter at said throat than at the entrance to the converging section of said nozzle.

5. An exhaust gas recirculation system as claimed in claim 1, further comprising a wiper member disposed in said channel at a location out of and close to the entrance to said nozzle in position relative a circumferential surface of said valve member wiped by said wiper member when said valve member moves axially.

6. An exhaust gas recirculation system as claimed in claim 5, wherein said wiper member is a tapered member having an arc-shaped cross section, the system further comprising support means for constantly pushing said tapered member against said surface of said valve member, said support comprising means allowing said tapered member to move normal to the longitudinal axis of said valve member when said valve member moves axially.

7. An exhaust gas recirculation system as claimed in claim 5, wherein said wiper member is of a resilient and lubricating material.

8. An exhaust gas recirculation system as claimed in claim 7, wherein said wiper member is an angular member having a plurality of radial slits spaced in a circumferential direction and terminating at the periphery of a central hole thereof.

* * * * *